US007557788B1

(12) United States Patent
Orlando et al.

(10) Patent No.: US 7,557,788 B1
(45) Date of Patent: Jul. 7, 2009

(54) GAMMA REFERENCE VOLTAGE GENERATOR

(75) Inventors: Richard V. Orlando, Los Gatos, CA (US); Trevor A. Blyth, Sandy, UT (US)

(73) Assignee: Alta Analog, Inc., San Jose, CA (US)

( * ) Notice: Subject to any disclaimer, the term of this patent is extended or adjusted under 35 U.S.C. 154(b) by 0 days.

(21) Appl. No.: 11/743,014

(22) Filed: May 1, 2007

Related U.S. Application Data

(63) Continuation of application No. 10/746,333, filed on Dec. 23, 2003, now Pat. No. 7,233,305.

(60) Provisional application No. 60/477,680, filed on Jun. 11, 2003.

(51) Int. Cl.
*G09G 3/36* (2006.01)

(52) U.S. Cl. ..... 345/89; 345/690; 348/674

(58) Field of Classification Search ..... 345/89, 345/690; 348/254, 674; 358/519
See application file for complete search history.

(56) References Cited

U.S. PATENT DOCUMENTS

| | | | | |
|---|---|---|---|---|
| 5,754,150 | A * | 5/1998 | Matsui | 345/89 |
| 6,373,478 | B1 * | 4/2002 | Steffensmeier | 345/204 |
| 6,593,934 | B1 * | 7/2003 | Liaw et al. | 345/590 |
| 7,233,305 | B1 * | 6/2007 | Orlando et al. | 345/89 |

* cited by examiner

*Primary Examiner*—Richard Hjerpe
*Assistant Examiner*—Tom V Sheng
(74) *Attorney, Agent, or Firm*—Fernandez & Associates, LLP

(57) ABSTRACT

A programmable buffer integrated circuit which can be programmed to output a set of gamma correction reference voltages to be used in LCD displays. Once programmed, the buffers will continuously output the programmed value. The device incorporates a programming interface to allow the programming of the buffer outputs to the desired values during manufacturing and test of the panel. Multiple sets of values can be programmed to provide different gamma correction curves for different user or application requirements.

6 Claims, 6 Drawing Sheets

200

FIG. 4A

PIN DESCRIPTIONS

| Name | Description | Value Range | Function |
|---|---|---|---|
| VDD | Digital Supply Input | 3V to 3.3V | |
| CH0-CH17 | Analog Outputs | 0V –VREF-0.2 | Analog Output Voltage Channels |
| B0-B2 | Bank Select | CMOS Inputs | Selects which output is placed in tracking mode or is written to during a write operation |
| VREFH | Output High Level Reference | 5-13.5 Volts | Sets the highest voltage for the output channels. |
| $A_{OUT}$ | Analog Output | 0.2V-VREFH-0.2 | Outputs the current value of the selected channel of the selected bank during programming |
| $V_{PP}$ | Programming Voltage | 10-14Volts | Provides the programming voltage and timings needed to program the analog memory cells. Also used to enter operating modes other than read. |
| A0-A1 | Address Inputs | TTL | Used to Select Programming Modes and Locations to be written |
| | | | |

FIG. 4B

Pinout

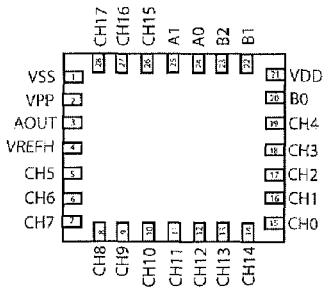

FIG. 5

ELECTRICAL PARAMETERS

| Symbol | Parameter | | Min | Typ | Max | Units | Condition |
|---|---|---|---|---|---|---|---|
| $V_{IL}$ | Input Low Voltage | A0-A2 | | | $V_{DD}$ x 0.3 | V | |
| $V_{IH}$ | Input High Voltage | A0-A2 | $V_{DD}$ x 0.7 | | | V | |
| $V_{OLA}$ | Output Low Voltage | AOUT, CH0-CH17 | 0.2 | | | V | $I_{OL}$ = 10mA |
| $V_{OHA}$ | Output High Voltage | AOUT, CH0-CH17 | | | $V_{REFH}$-0.2 | V | $I_{OH}$ = -10mA |
| $I_{IL}$ | Input Leakage Current | | | | ±1.0 | μA | |
| $I_{DD}$ | $V_{DD}$ Current (Operating) | | | | 1.5 | mA | $R_{EXT} = \infty$ |
| $I_{SB}$ | $V_{DD}$ Current (Standby) | | | | 10 | μA | |
| IVREH | VREF Current | | | | 190 | mA | |
| $V_{PP}$ | VPP Range | | 10 | | 14 | V | |
| VAC | Accuracy | | 15 | | | mV | |
| Vdrift | Output Drift | | | | 70 | μV | 10 Years at 125 Deg C |
| PSRR | Power Supply Rejection Ratio | | 45 | 60 | | DB | VDD = 3.3-5.5V |
| Tdamp | Bank Switch Damp Time | | 10 | | | msec | |

BLOCK DIAGRAM (AG1818)

GAMMA REFERENCE VOLTAGE GENERATOR

CROSS-REFERENCE TO RELATED APPLICATION

This application claims priority under 35 U.S.C. § 120 from and is a continuation application of U.S. patent application Ser. No. 10/746,333 filed Dec. 23, 2003 now U.S. Pat. No. 7,233,305, which claims priority from U.S. Provisional Application Ser. No. 60/477,680 filed on Jun. 11, 2003.

FIELD OF THE INVENTION

The invention relates generally to the field of liquid crystal displays, and more particularly to TFT flat panel displays and a method of generating a gamma reference voltage.

DESCRIPTION OF RELATED ART

Gamma Correction has long been a problem for the manufacturers of Thin Film Transistor (TFT) Flat Panel Displays. The Gamma Correction curve becomes more complex as the display resolution increases. Each display often has a different response to the gamma correction reference voltages, resulting in the need to generate specific gamma reference voltages for each model of display as well as compensating for display to display variation due to manufacturing process variations.

A traditional approach to the Gamma Reference Generation problem has been to use Select-On-Test Resistors. These resistors allow the reference voltages to be fine-tuned to the requirements of the individual display. The testing, selection and mounting of these resistors has become a major production problem since the process is a manual one and prohibits automated assembly and test. In addition, once the resistors are mounted on the display PC board, the resistors cannot be easily changed to meet the growing requirements of individual customers for a specific Gamma characteristic.

Of course, even with the manual labor involved, Select-On-Test resistors are still the least expensive solution to this problem. Devices such as potentiometers, Electrically Erasable Potentiometers (E2POTS), digitally-controlled potentiometers (DCPs) and Digital to Analog Converters (DACs) all could perform this function in some ways better than the Select-On-Test resistors, but the cost is unacceptable.

FIG. 1 is a block diagram illustrating a conventional gamma reference circuit for a TFT display 105 using Select-On-Test-Resistors. In this case, source drivers 110, 111, . . . and 112 require a total of 16 gamma reference voltages 121 $GM_1$, 122 $GM_2$, 123 $GM_3$, 124 $GM_4$, 125 $GM_5$, 126 $GM_6$, 127 $GM_7$, 128 $GM_8$, 129 $GM_9$, 130 $GM_{10}$, 131 $GM_{11}$, 132 $GM_{12}$, 133 $GM_{13}$, 134 $GM_{14}$, 135 $GM_{15}$ and, 136 $GM_{16}$. The gamma reference voltages are derived by a resistive divider of 17 resistors 141 $R_1$, 142 $R_2$, 143 $R_3$, 144 $R_4$, 145 $R_5$, 146 $R_6$, 147 $R_7$, 148 $R_8$, 149 $R_9$, 150 $R_{10}$, 151 $R_{11}$, 152 $R_{12}$, 153 $R_{13}$, 154 $R_{14}$, 155 $R_{15}$, 156 $R_{16}$, 157 $R_{17}$ connected between a reference voltage 160 and ground 161. Since the loading of the source drivers 110, 111, and 112 changes dynamically, it is not possible to simply connect the resistive divider 141 $R_1$, 142 $R_2$, 143 $R_3$, 144 $R_4$, 145 $R_5$, 146 $R_6$, 147 $R_7$, 148 $R_8$, 149 $R_9$, 150 $R_{10}$, 151 $R_{11}$, 152 $R_{12}$, 153 $R_{13}$, 154 $R_{14}$, 155 $R_{15}$, 156 $R_{16}$, 157 $R_{17}$ to the inputs of the source drivers 110, 111, and 112, and some type of buffering are used, such gamma reference buffer ICs 170 and 171.

Initially the PC board is assembled without the resistors. An external test apparatus drives the test points TP1-TP16 until the desired Gamma correction is achieved. The values of the TP voltages are then used to calculate the resistors needed for the particular display under test (DUT) and the resistors are mounted on the PC board.

More recently quite complex approaches to Gamma correction have been published. U.S. Pat. No. 6,593,934 (1) and U.S. Pat. No. 6,046,719 (2) are examples of inventions which eliminate the "select-on-test" resistors. Both inventions teach quite complex digital approaches to this "analog" problem; consequently both inventions are quite expensive. Accordingly, it is desirable to design a gamma reference architecture that automates gamma adjustment and provides reprogrammable capability and achieves acceptable cost.

SUMMARY OF THE INVENTION

The invention is a programmable buffer integrated circuit which can be programmed to output a set of gamma correction reference voltages to be used in Liquid Crystal Displays (LCDs). Once programmed, the buffer will continuously output the programmed value; if power is removed, since the voltage value is stored in non-volatile, programmable memory, the gamma correction is retained. The device incorporates a programming interface to allow the programming of the buffer outputs to the desired values during manufacturing and test of the panel. Multiple sets of gamma values can be programmed and stored to provide optimized gamma correction curves for different user or application requirements.

In the preferred embodiment, the present invention allows automated assembly of an entire PC board, automated test and gamma adjustment, smaller and thinner physical size, lower power consumption, reprogrammable and non-volatile settings. Furthermore, the present invention advantageously allows a stand-alone solution such that it is not necessary to incorporate a micro controller unit (MCU).

Other structures and methods are disclosed in the detailed description below. This summary does not purport to define the invention. The invention is defined by the claims.

BRIEF DESCRIPTION OF THE DRAWINGS

FIG. 4A and FIG. 4B are descriptions of one alternative pin out.

FIG. 5 shows exemplary electrical parameter specifications of one embodiment.

DETAILED DESCRIPTION OF PREFERRED EMBODIMENT

Figure 1:
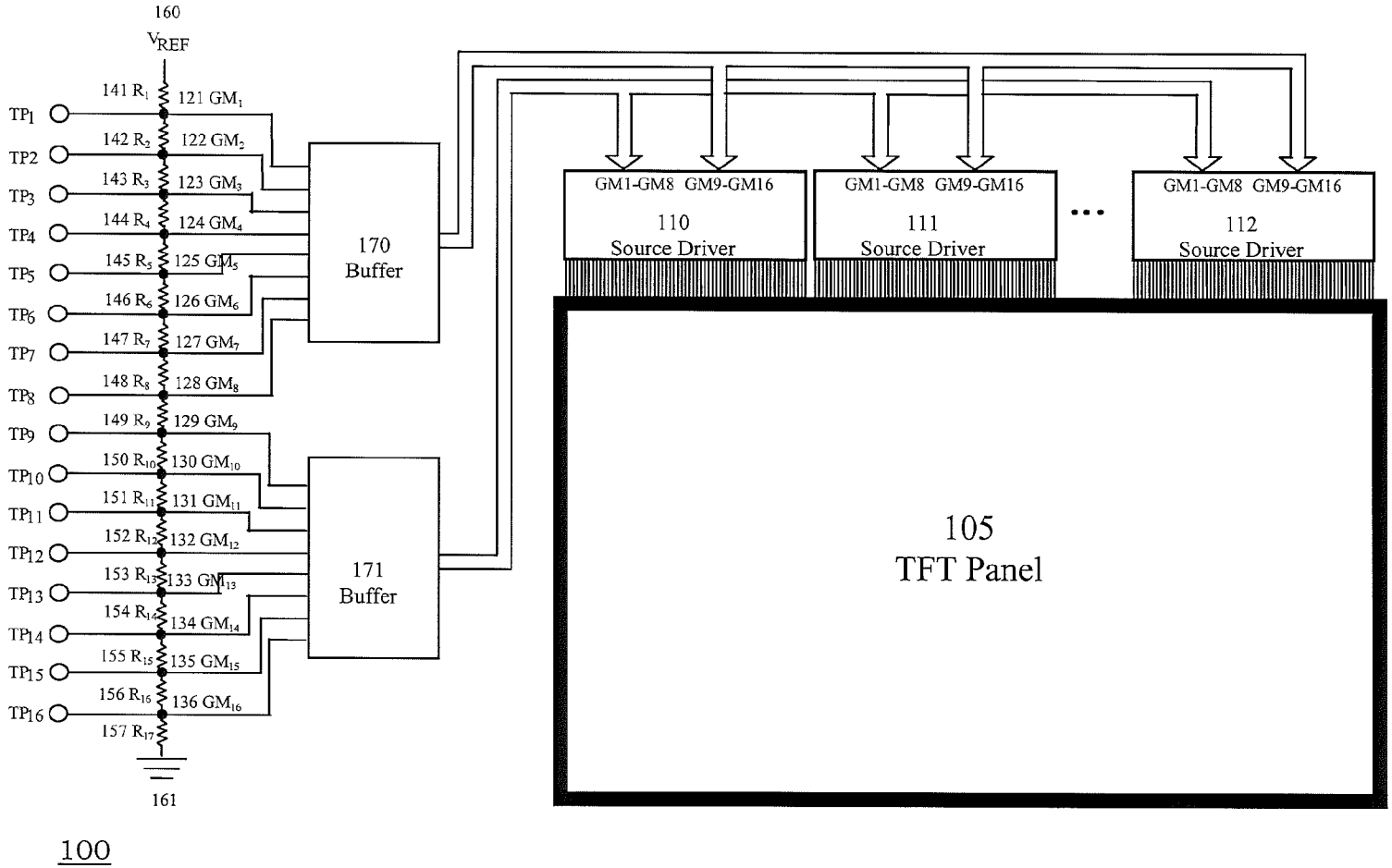
FIG. 1 is a prior art block diagram illustrating a conventional gamma reference circuit for a TFT display using Select-On-Test-Resistors.
Figure 2:
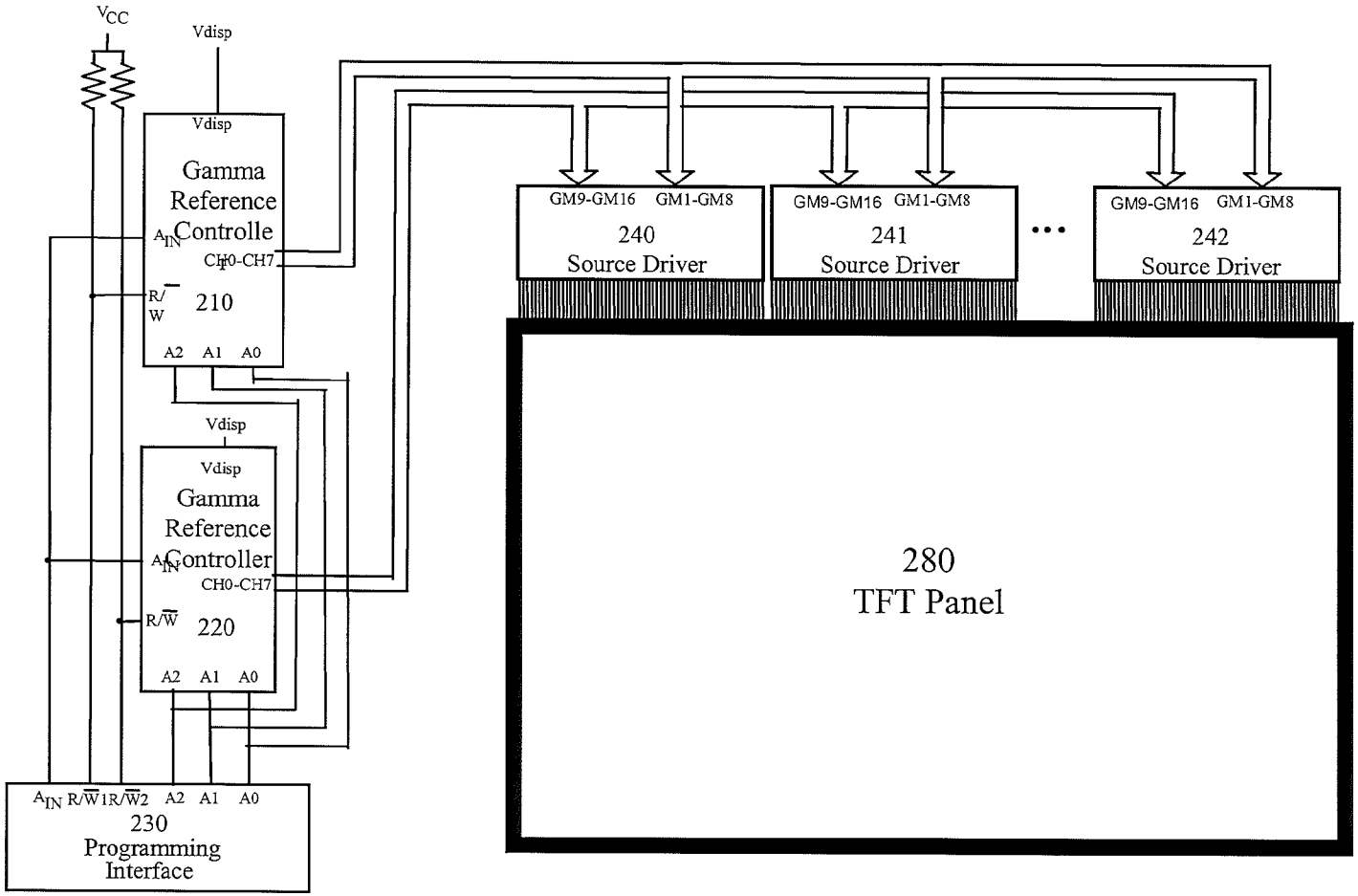
FIG. 2 is an architectural diagram illustrating a gamma reference circuit employing gamma reference controllers for a TFT display in accordance with one embodiment of the invention.

FIG. 2 is an architectural diagram, 200, illustrating a gamma reference circuit implementation employing gamma reference controllers, 210 and 220, for a TFT panel 280. The gamma reference circuit comprises a first gamma reference controller 210, a second gamma reference controller 220, a programming interface 230, source drivers 240, 241, and 242, and a TFT panel 280. The gamma reference controller 210 drives a first set of eight gamma reference voltages GM1-GM8 to the source drivers 240, 241, . . . and 242. The gamma reference controller 220 drives a second set of eight gamma reference voltages GM9-GM16 to the source drivers 240, 241, . . . and 242.

The Programming Interface 230 comprises a common Analog Input ($A_{IN}$) which will be used to set the reference voltage level, three address inputs ($A_0$, $A_1$, and $A_2$) to determine which reference level is being written and a R/W control signal for each of the first gamma reference controller 210 and second gamma reference controller 220, in this case two, that are on the board.

During normal operation, the R/W pin is pulled High and the reference voltage outputs will reflect the value last programmed into the nonvolatile memory cells.

The writing or programming operation is accomplished by first selecting the output or channel of the device to be programmed with the A2-A0 inputs. At this point, R/W on the device to be written is driven low and the device enters Tracking Mode. During Tracking Mode, the output of the selected channel tracks the input voltage on the Analog Input. (An optional internal voltage multiplier converts the 0-3V Analog Input to a 0-10 Volt output.)

Once the desired voltage is found by varying the Analog Input for a particular channel, the R/W signal is driven high and the value on the Analog Input is written into the nonvolatile memory for the output channel selected by the A2-A0 inputs.

In this manner, each of the gamma reference voltages can be written in a sequential manner during display testing.

Alternatively, the first gamma reference controller 210 and second gamma reference controller 220 can be pre-loaded with a default configuration, which is close to historical values for the majority of displays. In this approach, only those parameters that need to be adjusted are changed in testing.

The first gamma reference controller 210 and second gamma reference controller 220 provide the manufacturers of TFT displays a solution to the setting of the gamma reference voltages. Automated testing of the displays and re-programming of the gamma characteristics is enabled, even after the display is completed. The first gamma reference controller 210 and second gamma reference controller 220 provide reduced overall implementation costs, reduced power consumption, reduced physical size and flexibility over the traditional Select-On-Test resistor techniques.

Figure 3:
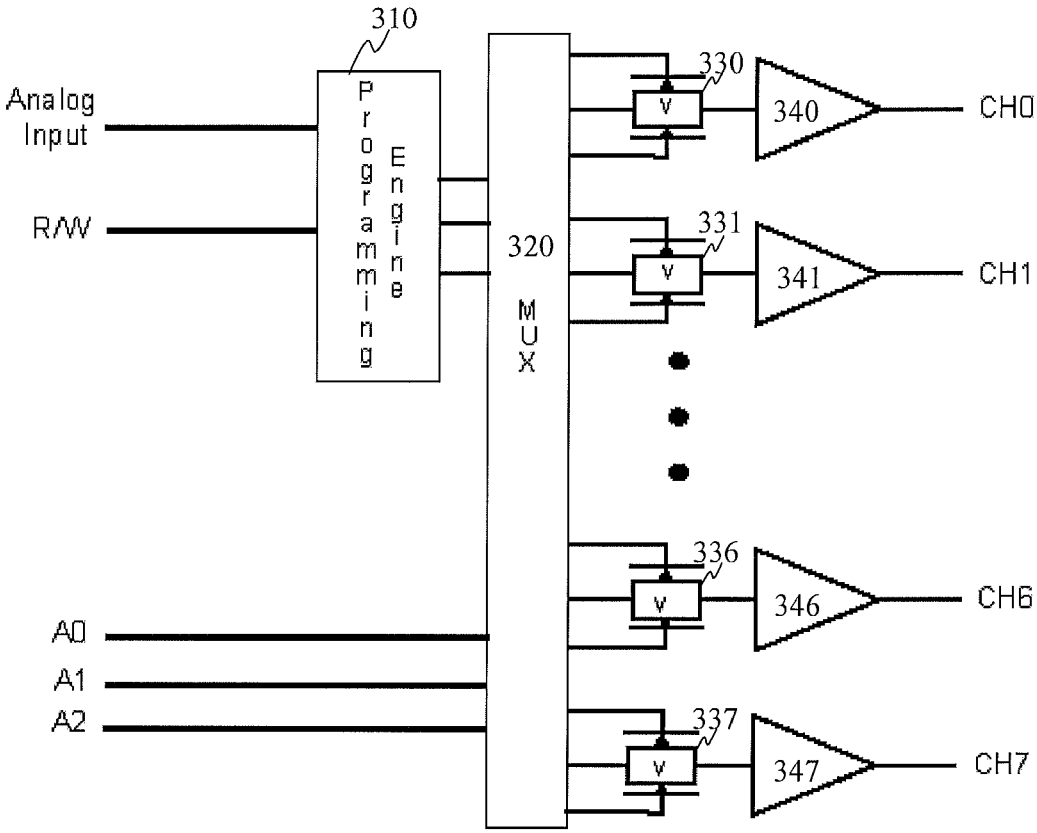
FIG. 3 is a block diagram illustrating one embodiment of a gamma reference controller in accordance with the invention.

FIG. 3 is a block diagram illustrating one embodiment of a gamma reference controller 300. The gamma reference controller 300 comprises a programming engine or interface 310, a mux 320, programmable analog floating gate memory cells 330, through 337, and drivers 340 through 347. The programming engine 310, coupled to the mux, comprises an Analog Input which will be used to set the reference voltage level and a R/W control signal for a corresponding gamma reference controller. The mux 320 connects signals from the programming engine 310 to any one of the programmable analog floating gate memory cells 330 through 337, depending on three address inputs ($A_0$, $A_1$, and $A_2$). Address inputs are used to select which cell is being written to at any time.

Each output is internally connected to an analog storage cell which can be written with analog values, for example, of 1024 step (10 Bit) resolution. The outputs, channel 0 (CH0), channel 1 (CH1), . . . channel 6 (CH6), and channel 7 (CH7), are intended to directly drive the reference voltage inputs of the source driver IC. An internal voltage multiplier, having a multiplication factor M, produces an output of zero up to typically 13.5 or alternatively 16 Volts. In FIG. 3, the channel 0, CH0, is driven by a driver 340, which connects to the programmable analog floating gate memory cells 330. The channel 1, CH1, is driven by a driver 341, which connects to the programmable analog floating gate memory cells 331. The channel 6, CH6, is driven by a driver 346, which connects to the programmable analog floating gate memory cells 336. The channel 7, CH7, is driven by a driver 347, which connects to the programmable analog floating gate memory cells 337.

During read mode, all channels continuously output their corresponding stored voltages. Applying a logic "0" to the R/W pin initiates a track and write cycle and the RDY\ pin goes to logic "1". The addressed channel now outputs a voltage which is equal to the voltage applied to the Vin pin, multiplied by the voltage multiplication factor M. The channel address may be changed during tracking mode. At the rising edge of R/W a write cycle is initiated and the present voltage applied to Vin is automatically stored in the analog memory corresponding to the addressed channel. Completion of the write cycle is indicated by a high to low transition at the RDY pin.

TABLE 1

| Name | Description | Value Range | Function |
|---|---|---|---|
| VDD | Supply Input | 3 V to 5.5 V | |
| Vdisp | Display Supply | 10 V to 12 V | |
| R/W | Read/Write | CMOS Input | When driven to an active low input, places the selected output into tracking mode. The Rising Edge of R/W writes the voltage on the analog input into the appropriate analog memory location |
| Rdy | Device Ready | TTL Compatible Output | |
| VSS | Ground | | |
| CH0-CH7 | Analog Outputs | 0 V-10 V | Analog Output Voltage Channels |
| VIN | Analog Input | 0 V-3 V | Analog Input Voltage |
| A0-A3 | Address Inputs | CMOS Inputs | Selects which output is placed in tracking mode or is written to during a write operation |

Table 1 shows an alternative example of the pin descriptions for a gamma reference controller.

TABLE 2

| Symbol | Parameter | Min | Typ | Max | Units | Condition |
|---|---|---|---|---|---|---|
| $V_{IL}$ | Input Low Voltage | | | $V_{DD} \times 0.3$ | V | |
| $V_{IH}$ | Input High Voltage | $V_{DD} \times 0.7$ | | | V | |
| $V_{OutL}$ | Analog Output Low Voltage Vin = 0.1 V Vdisp = 10 V | | 0.33 | | V | $I_{OL}$ = 10 mA |
| $V_{OutH}$ | Analog Output High Voltage Vin = 3 V Vdisp = 10 V | | 10 | | V | $I_{OH}$ = −10 mA |
| $V_{OL}$ | Logic Output Low Voltage | | | 0.4 | V | $I_{OL}$ = 0.3 mA |
| $V_{OH}$ | Logic Output High Voltage | $V_{DD} - 0.8$ | | | V | $I_{OH}$ = −250 μA |
| $I_{IL}$ | Input Leakage Current | | | ±1.0 | μA | |

TABLE 2-continued

| Symbol | Parameter | Min | Typ | Max | Units | Condition |
|---|---|---|---|---|---|---|
| $I_{DD}$ | $V_{DD}$ Current$_{(Operating)}$ | | | 0.8 | mA | $R_{EXT}$ = ∞ |
| | | | | 1.0 | mA | $R_{EXT}$ = ∞ |
| | | | | 1.5 | mA | $R_{EXT}$ = ∞ |
| $I_{SB}$ | $V_{DD}$ Current$_{(Standby)}$ | | | 10 | μA | |
| $V_{IN}$ | $V_{IN}$ Range | 0 | | $V_{DD}$ − 0.8 | V | |
| $R_{IN}$ | $V_{IN}$ Input Resistance | 1.0 | | | MΩ | |
| $AV_{IN}$ | Channel Gain | | 3.3 | | V/V | $V_{IN}$ to $V_{OUT}$ |

Table 2 shows an alternative example of the electrical parameters for a gamma reference controller.

Examples of eight to eighteen channel Gamma reference controllers have been used; clearly larger ones, 256 channels and higher, are encompassed by the invention. Various output voltage ranges are optional as well, 0-5V up to 0-16V, depending on the display requirements. Specific ranges or limits of the various parameters are used herein as examples of different embodiments and are not intended to limit the scope of the invention.

In one embodiment of the invention, the integrated circuit, termed the AG1818, is a programmable gamma reference generator with integrated output buffers to directly drive the source driver inputs of a display; in one embodiment the display is a TFT LCD. The circuit requires a single 3.3 volt supply, 1.5 mA operating current and consumes 10 μA in standby mode. FIGS. 4A and 4B show an alternative pin out of this embodiment.

Eighteen output channels are provided with an output range of 0 to 13.5 Volts and a drive capability of 10 milliamps. Each output is internally connected to an analog nonvolatile storage cell which can be written with 1,024 analog values, providing 10 bit resolution, or, said another way, to better than 15 mV resolution. The output of these analog nonvolatile memory cells is internally buffered to allow for the high voltages and current needed to directly drive the reference inputs on the source drivers. The outputs can be programmed from 0.2 volts to 0.2 volts below the VREFH value. FIG. 5 shows representative electrical specifications.

Figure 6:
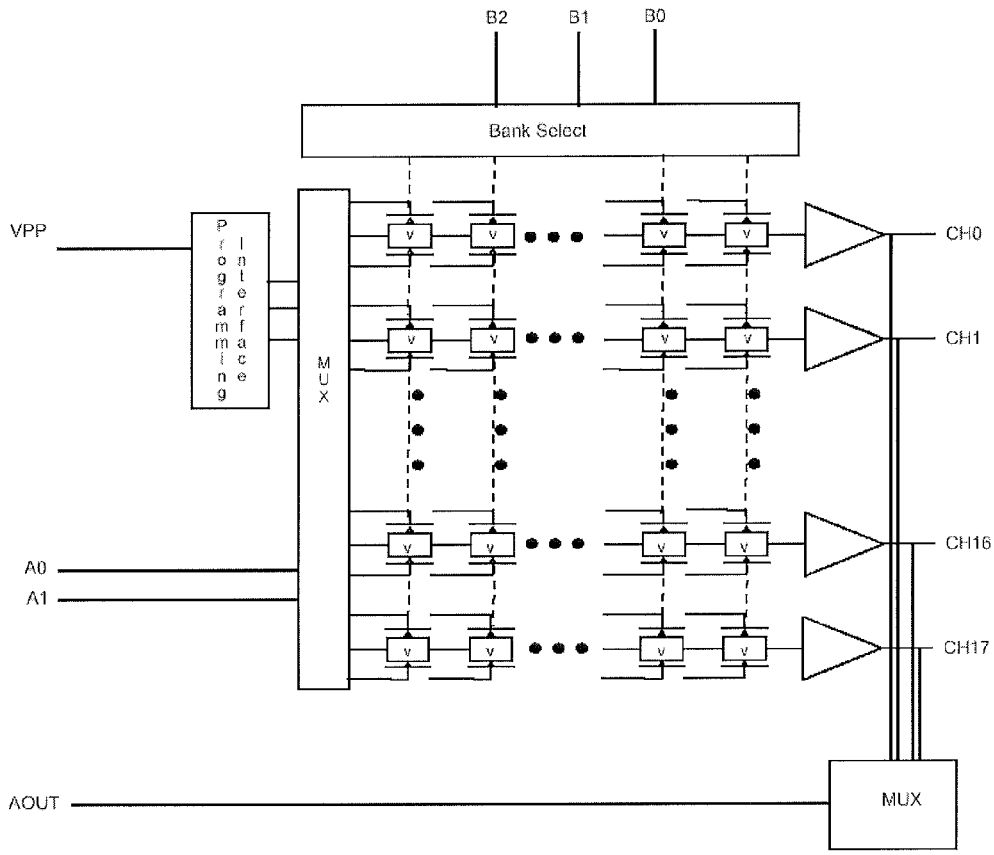
FIG. 6 is an alternative block diagram of one embodiment of the invention.

In one embodiment the AG1818 has capacity to store and retrieve eight independent banks or groups of reference voltages. The banks of gamma voltages are stored and selected through the three address inputs B0, B1, B2. This allows the gamma voltages to be changed either for dynamic gamma correction or application based gamma variation. This feature can also be used to switch between different gamma settings based on the information to be displayed for implementing dynamic gamma correction. A block diagram in FIG. 6 illustrates one alternative embodiment.

During read mode, all channels continuously output their corresponding stored voltages based on the bank selected by the B0-B2 address inputs. When deemed appropriate an internal damping circuit creates a slow transition, about 10 msec., between banks to prevent disruptive display artifacts caused by rapid transitions on the gamma reference voltages during operation. Alternative damping circuits may be employed which allow the transition between banks to be considerably slower, for instance, one second, as may be required by the display manufacturer's requirements.

An independent programming interface allows the device to be programmed in-situ thus providing the ability to individually program or adjust the gamma reference voltages for an individual display. The device can also be programmed prior to mounting on the pc board or display. The programming interface consists of four signals. The $V_{PP}$ is a high voltage input used to select the programming mode and also provides the high voltage pulses used to program the individual cells. In the AG1818 embodiment, $V_{PP}$ is supplied from an external source, an IC or other means. The $A_{OUT}$ analog output is used to read the cell which is currently being programmed to verify the write operation and proper output voltage level. The A0 through A1 inputs are used in conjunction with the B0-B2 inputs to select the location to be written.

One alternative method of programming the individual cells starts by placing A0, A1, B0, B1, B2 lines in the (1, 1, 1, 1, 1) state and taking the $V_{PP}$ pin high; this places the AG1818 in the Program mode; the read mode is the default mode. Next the particular bank is addressed through B0-B2; $V_{PP}$ is pulsed again, latching the bank address. Next the cell to be programmed in the selected bank is addressed using the A0, A1, B0, B1, B2 lines; $V_{PP}$ is pulsed again, a third time. At this point programming of the selected storage cell is initiated by pulsing $V_{PP}$ with adjustable voltage pulses between approximately 8 and 14 volts. When the selected cell has achieved the desired voltage level the A0, A1, B0, B1, B2 lines are again placed in the (1, 1, 1, 1, 1) state; the $V_{PP}$ pin is pulsed; this returns the AG1818 to the read mode. Programming of additional cells proceeds from the beginning sequence; any order of programming storage cells, random or sequential, can be applied.

Key variables in the programming process are programming voltage amplitude, rise and fall time of the pulse, and pulse duration; each of these variables is influenced by design and process parameters of the particular wafer fabrication facility. Real time monitoring of the cell voltage level is accomplished through the $A_{OUT}$ pin which reflects the cell voltage as it is in the output buffer which is the voltage which will be applied to the display column. The use of the $A_{OUT}$ pin provides an essential countermeasure to the vagaries of the design and fabrication processes. Independent of what voltage actually is stored in the cell the $A_{OUT}$ pin gives the ability for closed loop programming such that a precise gamma reference voltage is provided to a specific column. As mentioned previously, this programming step can take place prior to mating the gamma reference chip with a display wherein a predetermined set of voltage values is stored. Alternatively, the programming can take place after the gamma reference chip and display are mated; in this case the display quality can be evaluated as the gamma reference chip is being programmed if required.

One knowledgeable in the art that understands that other addressing schemes, such as a serial one, are possible, enabling an overall reduction in the pin count. Having bank switching capability ensures that the optimum gamma curve is used for each individual display and eliminates the need for re-work due to display manufacturing process variations. A PC based programming interface is available for prototyping and gamma optimization. This PC programming interface may be an alternative source of the $V_{PP}$ signals. Display optimization algorithms may be located in such a PC which also may be connected to monitors feeding back data from the display during the optimization tuning at time of manufacture.

This invention also enables several additional features for the user and manufacturer. Automating the testing of a panel can be achieved with optical sensors and feedback to the gamma correction section of the display. Once the optical sensors have modulated gamma reference voltage levels for the columns to achieve the predetermined light matching for the display these values can be saved in the gamma reference circuitry. In this way different application conditions can be pretested and stored. For the user, a sensor can be supplied with the display which responds to the temperature, lighting or other conditions present. The output of the sensor can be matched to a predetermined application condition which selects the corresponding gamma value set.

The above embodiments are only illustrative of the principles of this invention and are not intended to limit the invention to the particular embodiments described. Although the above embodiment describes the application of a gamma trimster for a TFT display, one of skill in the art should know that the present invention can be practiced in various types of displays and screens. Accordingly, various modifications, adaptations, and combinations of various features of the described embodiments can be practiced without departing from the scope of the invention as set forth in the appended claims.

We claim:

1. A method of calibrating a liquid crystal display to a desired gamma curve to compensate for panel to panel manufacturing variations comprising the steps:

a. providing said display with gamma reference control capability which is electrically reprogrammable and non-volatile;

b. testing said display with at least one sensor with optical input, wherein said sensor is separate from said display;

c. varying gamma reference voltage levels on columns of said display by a control circuit, wherein said control circuit is separate from said display;

d. optimizing said gamma reference voltage levels using means for executing a predetermined algorithm according to a predetermined criteria and data sensed by said at least one sensor, wherein said means for executing said predetermined algorithm is separate from said display to achieve the desired gamma curve; and e. storing said gamma reference voltage levels in said gamma reference control capability.

2. The method of claim 1 wherein the method is repeated more than once under different ambient display conditions to generate at least one different set of gamma reference voltage levels stored in said gamma reference control capability.

3. A method of programming one or more gamma reference voltage generator integrated circuits attached to a liquid crystal display comprising the steps:

a. selecting one or more columns on said liquid crystal display;

b. applying one or more different gamma voltages to said liquid crystal display columns;

c. storing said applied gamma voltages in reprogrammable, nonvolatile cells in said gamma reference voltage generator integrated circuits appropriate to said selected columns;

d. operating means for executing one or more optimization criteria algorithms based on optical emission corresponding to said selected columns, wherein said means for executing said one or more optimization criteria algorithms is separate from said liquid crystal display;

e. modifying said one or more different applied gamma voltages based on said one or more optimization criteria algorithms;

f. programming said applied gamma voltages in storage cells in said gamma reference voltage generator integrated circuits appropriate to said selected columns; and g. repeating steps (d) through (f) until said one or more optimization criteria have been satisfied.

4. The method of claim 3 wherein said gamma reference voltage generator integrated circuit requires an external source for high voltage programming means.

5. A method for a liquid crystal display, comprising:

providing said liquid crystal display with gamma reference control capability which is electrically reprogrammable and non-volatile;

calibrating said liquid crystal display comprising:

a. testing said liquid crystal display with at least one sensor with optical input;

b. varying gamma reference voltage levels on columns of said liquid crystal display;

c. optimizing said gamma reference voltage levels using means for executing a predetermined algorithm according to a predetermined criteria and data sensed by said at least one sensor; and d. storing said gamma reference voltage levels in said gamma reference control capability;

retrieving said gamma reference voltage levels from said gamma reference control capability; and displaying an image on said liquid crystal display based on said gamma reference voltage levels.

6. The method of claim 5, wherein the calibrating step is repeated more than once under different ambient display conditions to generate at least one different set of gamma reference voltage levels stored in said gamma reference control capability.

* * * * *